United States Patent [19]

Christian

[11] 4,040,768

[45] Aug. 9, 1977

[54] MIXING, CONVEYING HEATING AND/OR COOLING APPARATUS

[75] Inventor: Robert Francis Christian, San Francisco, Calif.

[73] Assignee: Jude Engineering Incorporated, San Francisco, Calif.

[21] Appl. No.: 638,633

[22] Filed: Dec. 8, 1975

[30] Foreign Application Priority Data

Mar. 27, 1975 United Kingdom ..... 12997/75

[51] Int. Cl.[2] ..... B01F 7/08

[52] U.S. Cl. ..... 416/122; 416/176; 416/DIG. 3; 259/191

[58] Field of Search ..... 416/84–86, 416/122, 176, 177, DIG. 3; 259/191

[56] References Cited

U.S. PATENT DOCUMENTS

| | | | |
|---|---|---|---|
| 38,292 | 4/1863 | Degges | 416/176 |
| 88,595 | 4/1869 | Ward | 416/86 |
| 170,711 | 12/1875 | Chase | 416/176 X |
| 342,572 | 5/1886 | Bovyer | 416/176 |
| 1,830,985 | 11/1931 | Dreier | 416/84 |
| 2,611,590 | 9/1952 | Jebens | 416/122 X |
| 2,758,823 | 8/1956 | Vasby | 416/177 X |
| 3,143,768 | 8/1964 | Scherping | 416/176 X |
| 3,589,834 | 6/1971 | Cairelli | 416/122 |
| 3,606,580 | 9/1971 | Kaufman | 416/233 X |

FOREIGN PATENT DOCUMENTS

| | | | |
|---|---|---|---|
| 527,835 | 7/1956 | Canada | 416/176 |

*Primary Examiner*—Everette A. Powell, Jr.
*Attorney, Agent, or Firm*—William Anthony Drucker

[57] ABSTRACT

A helical blade is provided for a mixing or conveying apparatus which can be used for heating or cooling or in general effecting a thermal treatment such as drying, evaporating calcining or crystallizing a product fed to the apparatus. The blade comprises a pair of pressed ring shaped discs welded together. One disc is shaped with its inner margin curved into or nearly into the axial direction, and the other disc is welded to it at its inner and outer margins. The blade may be welded directly to a shaft, mounted freely thereon or welded to blocks on the shaft to provided spaces between the flights of the blade and the shaft.

4 Claims, 4 Drawing Figures

MIXING, CONVEYING HEATING AND/OR COOLING APPARATUS

This invention relates to helical blade mixing and/or conveying apparatus having a hollow blade mounted on a shaft which can also if required be used for heating or cooling or in general to effect a thermal treatment such as drying, evaporation, calcination crystallisation, of the product fed to the apparatus. An example of such an apparatus is described in British patent specification No. 1273131.

An object of the present invention is to simplify and cheapen the manufacture of the hollow blades.

Another object of the invention is to improve the efficiency of the mixing and heating or cooling and in general the exchange of heat in the aforesaid thermal treatments.

According to the invention the helical blade is made from pairs of ring shaped discs welded together, one disc being shaped with its inner margin curved into or nearly into the axial direction and the other disc being welded to the first disc at its inner and outer margins.

The blade between its ends may be welded directly to the shaft or may run freely on the shaft to allow for expansion and contraction. Preferably the blade between its ends is mounted to ride on blocks which are welded to the shaft e.g. blocks in the form of short circular pins, leaving spaces between the blade flights and the shaft through which the product can pass.

The apparatus may include two shafts each carrying a helical blade, the two blades being interleaved with each other so that the outer margin of each blade is spaced a short distance from the opposite shaft. With blades having curved inner margins spaced from the shafts the product tends to surge through the spaces between the blades and the shafts to produce a very efficient mixing and heating or cooling of the product as each blade tends to urge the product through the spaces at the other blade.

The invention will be further described by way of example with reference to the accompanying drawings wherein.

Figure 2:
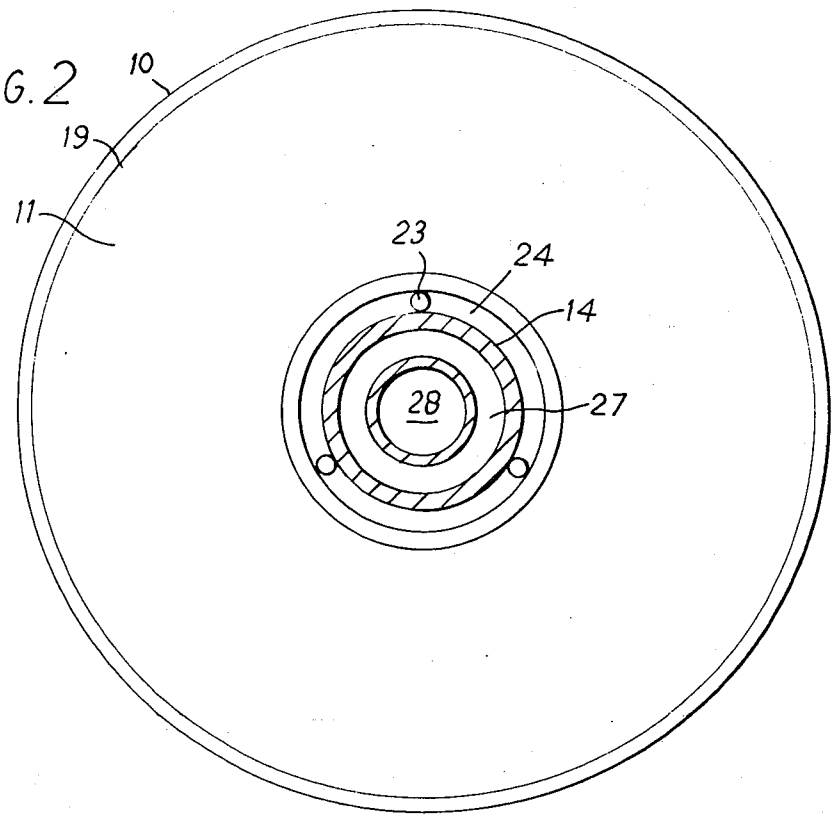
FIG. 2 is an end view thereof.
Figure 1:
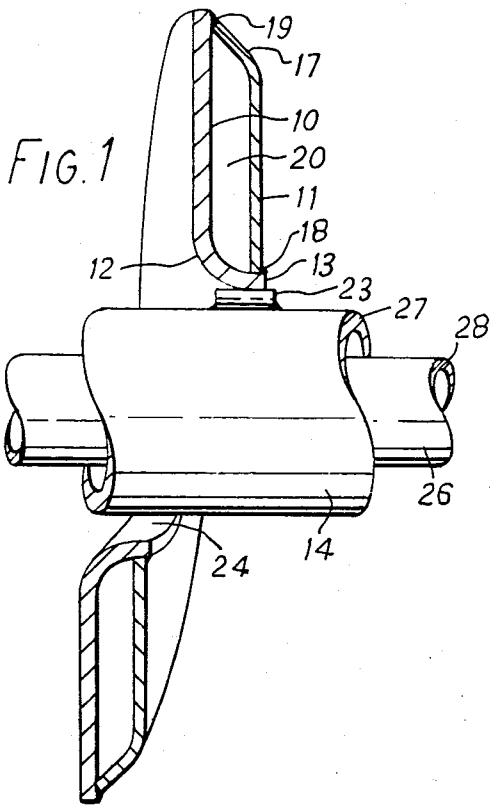
FIG. 1 is a sectional view of a part of a hollow blade made in accordance with the invention and its shaft.

The blade is made from pairs of flat ring shaped discs which are split radially and then pressed into the shapes shown at 10 and 11. The discs are of spiral or helical shape and the disc 10 has its inner margin curved at 12 so that at 13 it is parallel or nearly parallel to the shaft

14. The remainder of the disc is disposed radially. The disc 11 is mainly radial but curved at its outer margin at 17 and is welded at its inner and outer edges 18, 19 to the disc 10 leaving a space 20 between the discs to receive heating or cooling fluid.

Small cylinder blocks or pins 23 are welded to the shaft 14 at intervals around the shaft and the inner margin of the disc 10 seats on these blocks leaving spaces 24 between the inner margin and the shaft through which the product being treated can pass.

An inner hollow shaft 26 is positioned within the blade shaft 14 to leave a space 27 between the shafts and 28 within the inner shaft for circulation of heating or cooling fluid.

Figure 3:
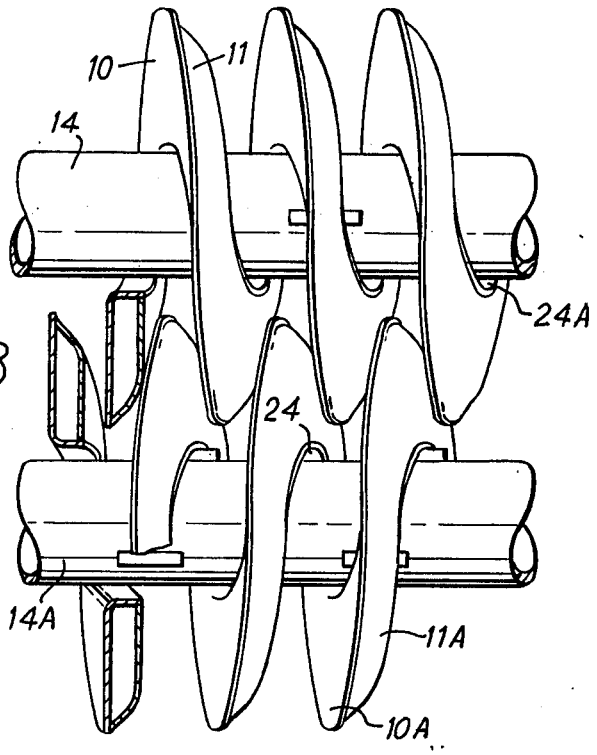
FIG. 3 is a side view of two interleaved blades and their shafts.
Figure 4:
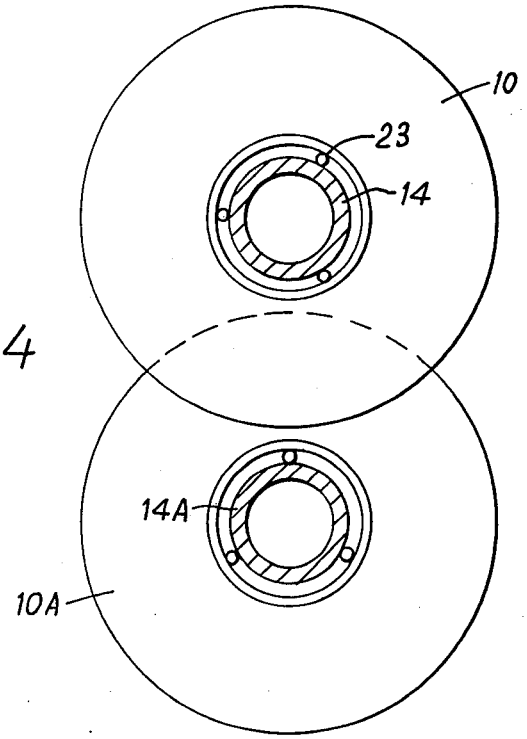
FIG. 4 is an end view thereof.

When two such blades (10, 11 and 10A, 11A) are mounted on adjacent shafts 14, 14A as shown in FIGS. 3 and 4 the blades are interleaved so that the outer margin of each blade is spaced a short distance from the adjacent shaft. Although the general direction of conveyance is left to right in FIG. 3 there will be a movement of the product in the opposite direction through the spaces 24, 24A thereby producing a surging action of the product with increased efficiency of mixing and heating or cooling.

I claim:

1. A heat exchange apparatus comprising a shaft and a hollow helical blade mounted on and surrounding the shaft, said blade being made of pairs of helically shaped split discs, the first disc of each pair being shaped with its inner margin curved into or nearly into the axial direction, the remainder of the disc being substantially radial to the shaft, and the second disc being welded to the first disc at its inner edge to the outer surface of the inner margin of the first disc and its outer margin curved towards the first disc and welded to it, the remainder of the second disc being substantially radial to the shaft, the discs being spaced apart between their inner and outer edges to form a single continuous space extending helically around the shaft and through which a heat exchange medium can flow through the hollow blade.

2. An apparatus as claimed in claim 1 wherein the blade between its ends is mounted to ride on blocks which are welded to the shaft, the curved inner margins of the first disc of each pair seating on said blocks.

3. An apparatus as claimed in claim 2 wherein the blocks are in the form of short circular pins, leaving spaces between the blade flights and the shaft.

4. An apparatus as claimed in claim 1 including two such shafts each carrying a helical blade, the two blades being interleaved with each other so that the outer margin of each blade is spaced a short distance from the opposite shaft.

* * * * *